US012538987B2

(12) United States Patent
Alletto, Jr.

(10) Patent No.: US 12,538,987 B2
(45) Date of Patent: Feb. 3, 2026

(54) NEGATIVE PRESSURE MATTRESS SYSTEM

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 0 days.

(21) Appl. No.: 17/475,867

(22) Filed: Sep. 15, 2021

(65) Prior Publication Data

US 2022/0000270 A1 Jan. 6, 2022

Related U.S. Application Data

(63) Continuation of application No. 15/949,412, filed on Apr. 10, 2018, now Pat. No. 11,134,790.

(51) Int. Cl.
*A47C 21/04* (2006.01)

(52) U.S. Cl.
CPC ..... *A47C 21/044* (2013.01)

(58) Field of Classification Search
CPC ..... A47C 21/044; A47C 21/04; A47C 21/042; A47C 21/046; A47C 21/048; A61G 7/05784
See application file for complete search history.

(56) References Cited

U.S. PATENT DOCUMENTS 1,142,876 A * 6/1915 Davis ..... A47C 21/048 5/284
5,640,728 A 6/1997 Graebe
5,887,304 A 3/1999 von der Heyde
5,924,164 A * 7/1999 Lindsay, Jr. ..... A47L 9/2852 15/314
6,425,527 B1 * 7/2002 Smole ..... A47C 21/044 5/423

(Continued)

FOREIGN PATENT DOCUMENTS

CN 102599757 B 8/2014
EP 3609367 A1 2/2025

(Continued)

OTHER PUBLICATIONS

National Intellectual Property Administration, P.R.C, Application No. 201880031289.X, Applicant: Bedgear, LLC, Second Office Action, Issue Date: Jan. 12, 2022.

(Continued)

*Primary Examiner* — Matthew Troutman
*Assistant Examiner* — Alison N Labarge
(74) *Attorney, Agent, or Firm* — Sorell, Lenna & Schmidt, LLP

(57) ABSTRACT

A bedding system includes a box layer having a duct and an inlet. The duct has a passageway that is in communication with the inlet. A capacitor layer includes a cavity that is in communication with the passageway. A mattress layer includes a bottom surface and a top surface that defines a sleep surface. A hole extends through the top and bottom surfaces and is in communication with the cavity. A central vacuum system includes a power unit, a pipe having a first end that is connected to the power unit and a second end connected to an outlet and a hose having a first end that is connected to the outlet and a second end that is connected to the at least one inlet.

19 Claims, 12 Drawing Sheets

(56) References Cited

U.S. PATENT DOCUMENTS

| | | | | |
|---|---|---|---|---|
| 9,138,064 | B2 | 9/2015 | Tursi, Jr. et al. | |
| 9,289,072 | B2 | 3/2016 | Albero et al. | |
| 9,392,875 | B2 | 7/2016 | Weyl | |
| 9,955,791 | B2 * | 5/2018 | Chandler | A47C 27/18 |
| 10,154,933 | B2 | 12/2018 | Albero et al. | |
| 11,134,790 | B2 | 10/2021 | Alletto, Jr. | |
| 2008/0148481 | A1 * | 6/2008 | Brykalski | A47C 21/048 5/423 |
| 2011/0035879 | A1 | 2/2011 | Grinstead et al. | |
| 2015/0121621 | A1 * | 5/2015 | Aramli | A47C 21/048 5/423 |
| 2015/0208814 | A1 * | 7/2015 | Alletto, Jr | A47C 27/00 5/423 |
| 2015/0327686 | A1 | 11/2015 | Tursi et al. | |
| 2016/0136385 | A1 * | 5/2016 | Scorcioni | A61B 5/4812 600/26 |
| 2017/0360212 | A1 * | 12/2017 | Rawls-Meehan | A47C 27/14 |

FOREIGN PATENT DOCUMENTS

| | | | |
|---|---|---|---|
| KR | 20110031538 | A | 3/2011 |
| WO | 2018191236 | A1 | 10/2018 |

OTHER PUBLICATIONS

International Preliminary Report on Patentability, International Bureau of WIPO, PCT/US2018/026845, mailed Oct. 15, 2019.

European Patent Office, 2280 HV Rijswijk, Netherlands, Communication pursuant to Article 94(3) EPC, Application No. 18720 740.2, Date: Sep. 9, 2022.

Canadian 2nd Office Action. Canadian Intellectual Property Office. Canada Appl No. 3,059,566. dtd Mar. 5, 2025. 1 pg.

* cited by examiner

NEGATIVE PRESSURE MATTRESS SYSTEM

CROSS-REFERENCE TO RELATED APPLICATIONS

This application is a continuation application of U.S. patent application Ser. No. 15/949,412, Apr. 10, 2018, which claims priority to U.S. Patent Application Ser. No. 62/483,624, filed Apr. 10, 2017. These applications are expressly incorporated by reference herein, in their entireties.

TECHNICAL FIELD

The present disclosure generally relates to systems configured to create negative pressure to draw ambient air away from a sleeping surface of a mattress. Methods of use are included.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that suit both their personal sleep preference and body type in order to achieve comfortable, restful sleep.

Mattresses are an important aspect in achieving proper sleep. It is therefore beneficial to provide a mattress capable of maintaining a preselected temperature based on a user's sleep preference, so that the user achieves maximum comfort during sleep. However, conventional mattresses fail to create negative pressure to draw ambient air away from a sleeping surface of the mattress. This disclosure describes an improvement over these prior art technologies.

SUMMARY

In one embodiment, in accordance with the principles of the present disclosure, a bedding system is provided that includes a box layer comprising at least one duct and at least one inlet. The at least one duct has a passageway that is in communication with the at least one inlet. A capacitor layer is positioned above the box layer and includes a cavity that is in communication with the passageway. A mattress layer is positioned above the capacitor layer and includes a bottom surface and an opposite top surface that defines a sleep surface. The mattress layer comprises at least one hole that extends through the top and bottom surfaces and is in communication with the cavity. A central vacuum system comprises a power unit, at least one pipe having a first end that is connected to the power unit and a second end connected to an outlet and a hose having a first end that is connected to the outlet and a second end that is connected to the at least one inlet. In some embodiments, the power unit is configured to create a vacuum that draws air from the sleep surface and moves the air through the at least one hole and into the cavity such that the air moves through the at least one duct and into the hose through the at least one inlet.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
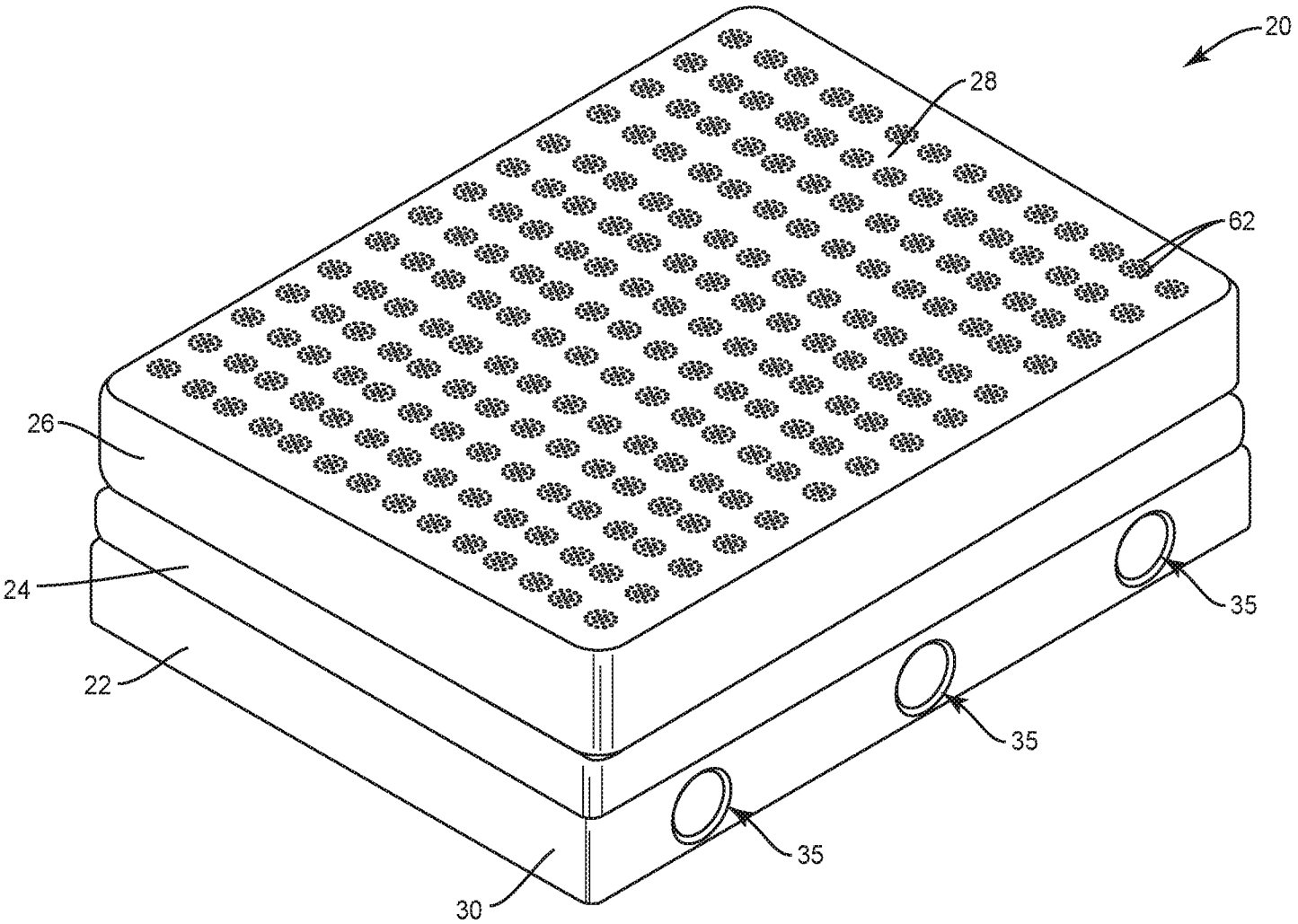
FIG. 1 is a perspective view of one embodiment of a bedding system in accordance with the principles of the present disclosure.

The exemplary embodiments of a bedding system and methods of use are discussed in terms of a bedding system that creates negative pressure to draw air away from a sleep surface of a mattress to regulate the temperature of the sleep surface. The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of an ambient bed having a heat reclaim system, related components and methods of using the ambient bed system in accordance with the principles of the present disclosure. Alternate embodiments are also disclosed. Reference will now be made in detail to the exemplary embodiments of the present disclosure, which are illustrated in the accompanying figures. Turning to FIGS. 1-15, there are illustrated components of a bedding system 20.

The components of bedding system 20 can be fabricated from materials including metals, polymers and/or composites, depending on the particular application. For example, the components of bedding system 20, individually or collectively, can be fabricated from materials such as fabrics or textiles, paper or cardboard, cellulosic-based materials, biodegradable materials, plastics and other polymers, metals, semi-rigid and rigid materials. Various components of bedding system 20 may have material composites, including the above materials, to achieve various desired characteristics such as strength, rigidity, elasticity, performance and durability. The components of bedding system 20, individually or collectively, may also be fabricated from a heterogeneous material such as a combination of two or more of the above-described materials. The components of bedding system 20 can be extruded, molded, injection molded, cast, pressed and/or machined. The components of bedding system 20 may be monolithically formed, integrally connected or include fastening elements and/or instruments, as described herein.

In one embodiment, shown in FIGS. 1-17, bedding system 20 includes a box layer 22, a capacitor layer 24 positioned above box layer 24 and a mattress layer 26 positioned above capacitor layer 24. Mattress layer 26 includes a sleep surface 28. If the temperature adjacent to sleep surface 28 deviates from a temperature selected by a user, bedding system 20 will create negative pressure that draws air away from sleep surface 28, as discussed herein.

As shown in FIGS. 1-4, box layer 22 comprises a housing 30 configured to support, enclose and/or protect other components of box layer 22, such as, for example, one or a plurality of ducts 34. It is envisioned that box layer 22 and/or housing 30 can have any size or shape, depending upon the requirements of a particular application. For example, box layer 22 and/or housing 30 can be sized to substantially conform to the size and shape of a particular mattress, such as, for example, a twin mattress, a queen mattress, a king mattress, etc. Ducts 34 each define a passageway 32. Passageways 32 are each in communication with an opening, such as, for example, an inlet 35 that extends through a wall of housing 30.

It is envisioned that housing 30 may include any number of ducts 34, such as, for example, one duct 34, two ducts 34, three ducts 34, four ducts 34, five ducts 34, six ducts 34, seven ducts 34, eight ducts 34, nine ducts 34, ten ducts 34, etc. In one embodiment, a first sidewall of housing 30 includes three inlets 35 that are spaced apart from one another and an opposite second sidewall of housing 30 includes three inlets 35 that are spaced apart from one another. Each of inlets 35 in the first sidewall is coaxial with one of inlets 35 in the second sidewall. It is envisioned that the first sidewall of housing 30 and the second sidewall of housing 30 may each include one or a plurality of inlets 35. In some embodiments, at least one of the end walls of housing 30 that extend between the first and second sidewalls of housing 30 include one or a plurality of inlets 35 in place of or in addition to inlets 35 in the first sidewall and/or the second sidewall. Passageways 32 of ducts 34 are each in communication with one of inlets 35 such that air within passageways 32 can move out of housing 30 and into an area surrounding bedding system 20 through inlets 35. Ducts 34 each extend from a first end 36 that is coupled to one of inlets 35 and an opposite second end 38. Ducts 34 each include an arcuate portion between first end 36 and second end 38 such that an opening in first end 36 extends perpendicular to an opening in second end 38, as shown in FIGS. 3 and 4, for example.

Figure 3:
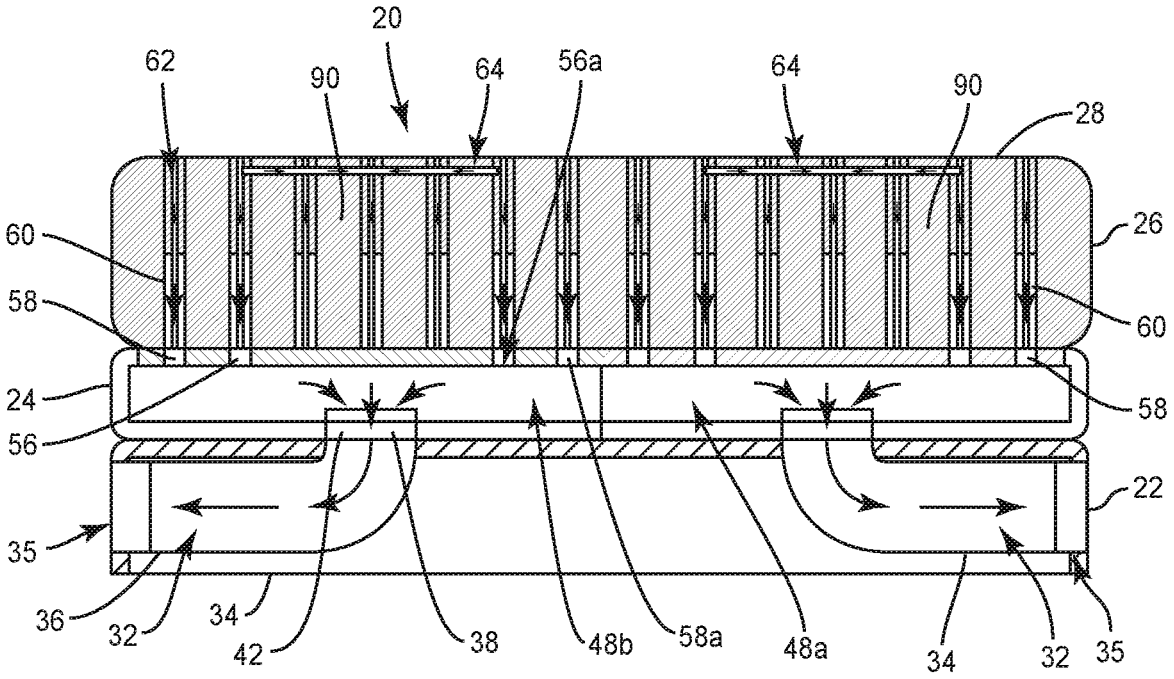
FIG. 3 is a cross-sectional view of components of the system shown in FIG. 1 taken along lines A-A in FIG. 2.
Figure 4:
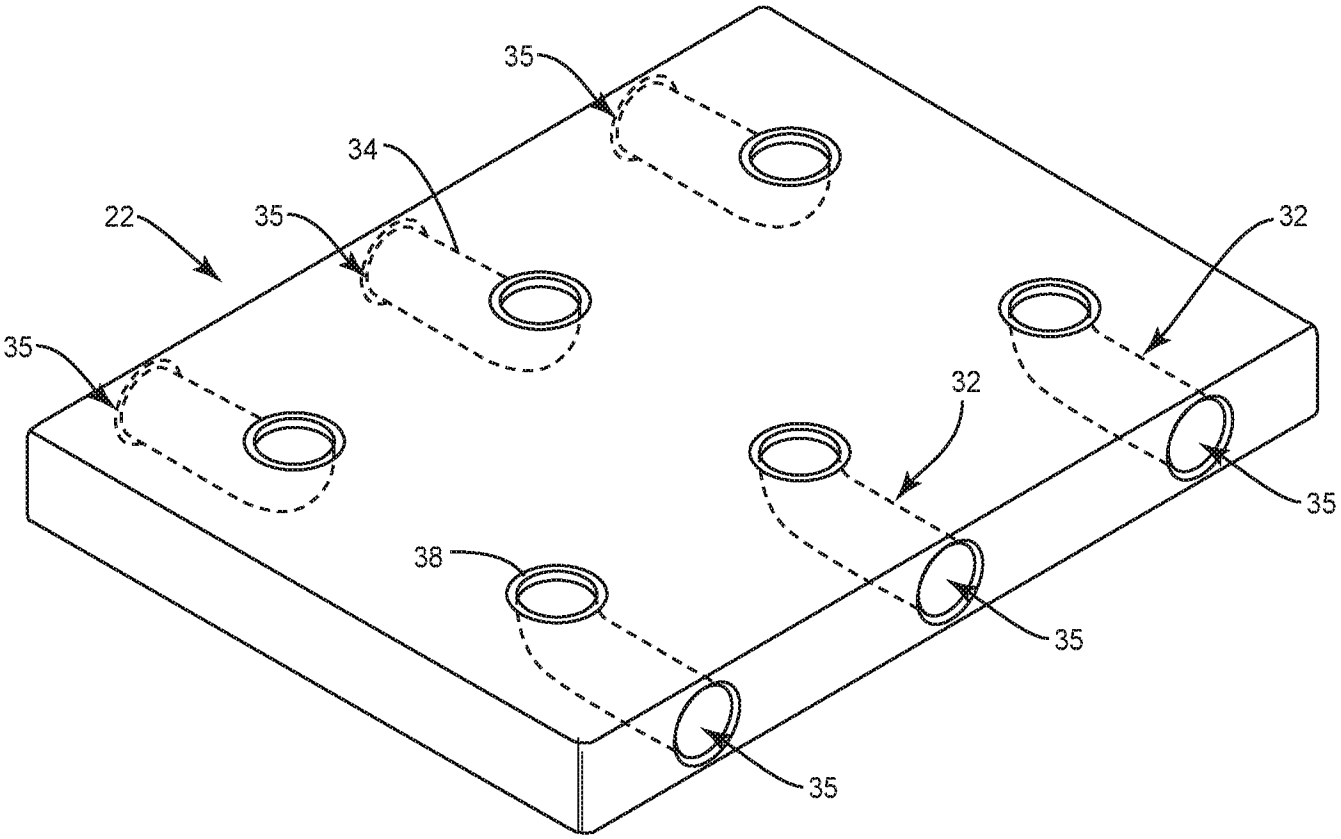
FIG. 4 is a perspective view of components of the system shown in FIG. 1.
Figure 5:
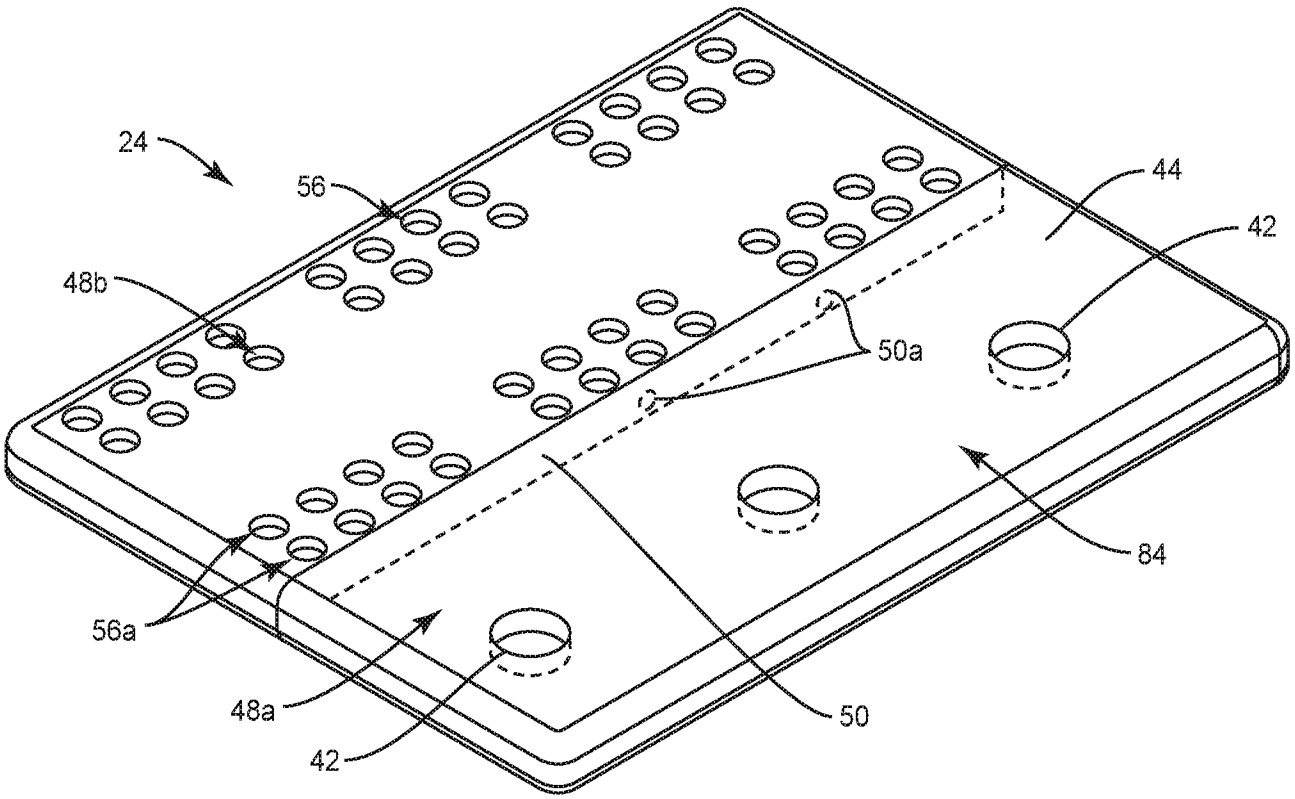
FIG. 5 is a perspective view, in part phantom, of components of the system shown in FIG. 1.

Capacitor layer 24 is positioned atop box layer 22 such that second ends 38 of ducts 34 are each coupled to an outlet port 42 of capacitor layer 24, as shown in FIG. 3, such that openings in outlet ports 42 are in communication with the openings in second ends 38 of ducts and passageways 32 of ducts 34. Outlet ports 42 extend upwardly from a bottom surface 44 of capacitor layer 24 and terminate prior to a top surface 46 of capacitor layer 24, as shown in FIG. 5. Top surface 46 and bottom surface 44 define a hollow compartment, such as, for example, a cavity 48 therebetween. In one embodiment, cavity 48 is divided into a first section 48*a* and a second section 48*b* by a wall 50, as shown in FIG. 5. In one embodiment, wall 50 includes one of a plurality of openings 50*a* to allow air within first section 48*a* to move into second section 48*b*, and vice versa. It is noted that a portion of top surface 46 that covers first section 48*a* of compartment 48 has been removed in FIG. 5 in order to view the contents of first section 48*a*. In one embodiment, first section 48*a* is a mirror image of second section 48*b*. In one embodiment, capacitor layer 24 does not include wall 50 and cavity 48 is a single cavity. That is, cavity 48 is not divided into first section 48*a* and second section 48*b* by wall 50.

Figure 6:
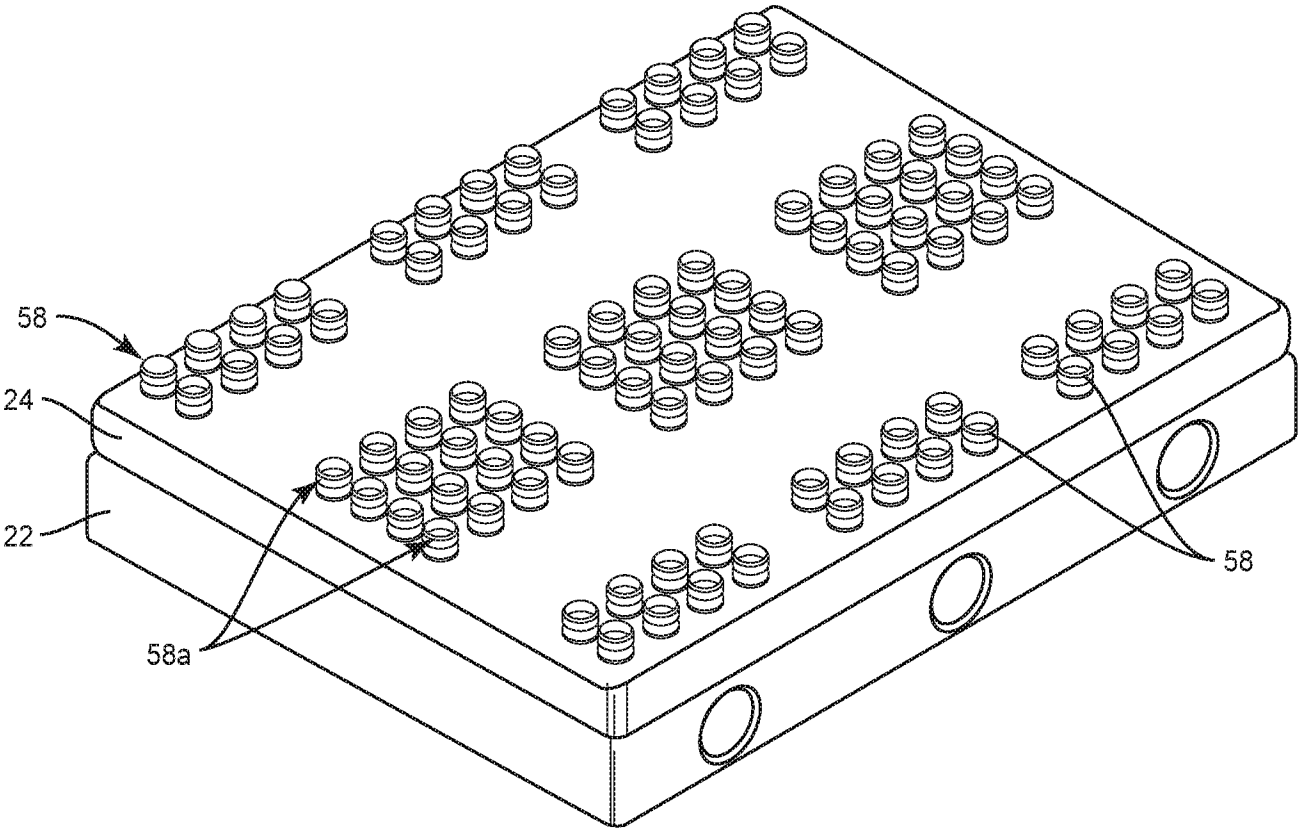
FIG. 6 is a perspective view of components of the system shown in FIG. 1.
Figure 7:
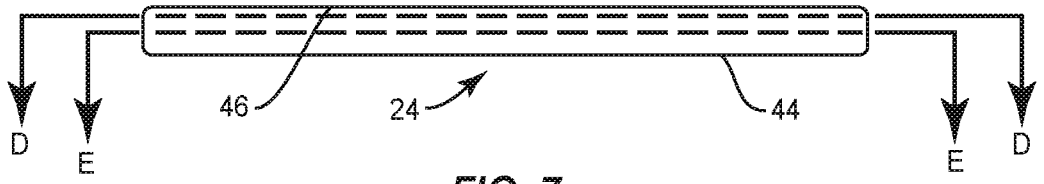
FIG. 7 is a side view of components of the system as shown in FIG. 1.
Figure 8:
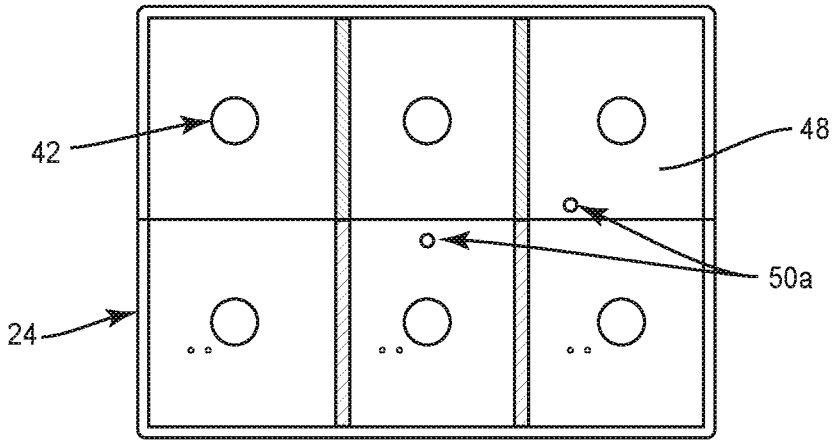
FIG. 8 is a cross-sectional view of components of the system shown in FIG. 1 taken along lines D-D in FIG. 7.
Figure 9:
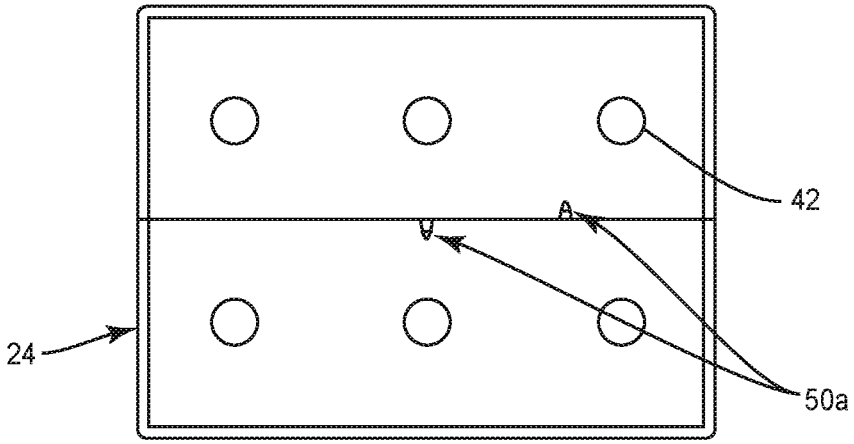
FIG. 9 is a cross-sectional view of components of the system shown in FIG. 1 taken along cross-sectional lines E-E in FIG. 7.
Figure 10:
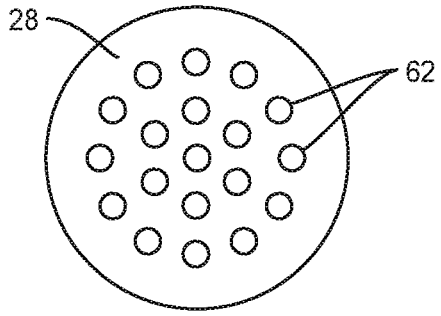
FIG. 10 is a top, detailed view of components of the system shown in FIG. 1.
Figure 11:
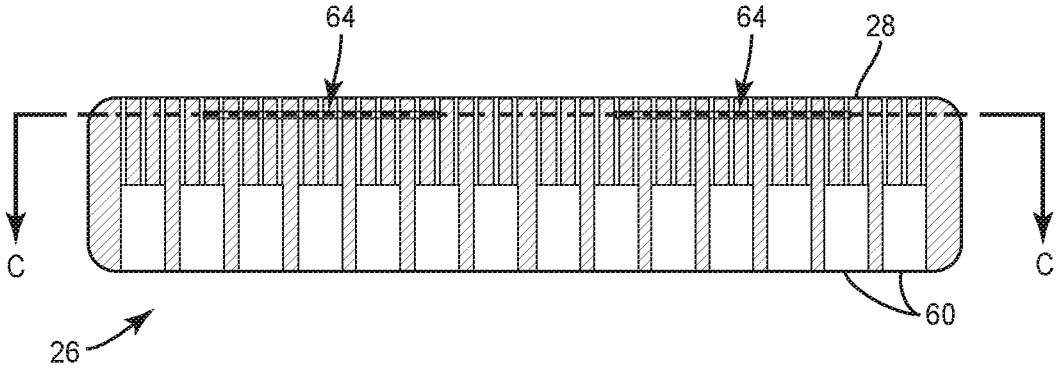
FIG. 11 is a cross-sectional view of components of the system shown in FIG. 1 taken along lines B-B in FIG. 13.

Top surface 46 of capacitor layer 24 includes a plurality of apertures 56 associated with each outlet port 42, as shown in FIG. 5. In one embodiment, shown in FIG. 5, top surface 46 includes eight apertures 56 for each outlet port 42. However, it is envisioned that top surface 46 may include one or a plurality of apertures 56 for each outlet port 42. Capacitor layer 24 includes a plurality of air flow aperture devices 58 extending upwardly from top surface 46 of capacitor layer 24, as shown in FIG. 6. Air flow aperture devices 58 are hollow and are each aligned with one of apertures 56. Each air flow aperture device 58 is aligned with one of apertures 56. In some embodiments, top surface 46 of capacitor layer 24 includes a plurality of apertures 56*a* positioned between aligned outlet ports 42, as shown in FIG. 5. It is envisioned that top surface 46 may include one or a plurality of apertures 56*a* positioned between each pair of aligned outlet ports 42. Capacitor layer 24 includes a plurality of air flow aperture devices 58*a* extending upwardly from top surface 46 of capacitor layer 24, as shown in FIG. 6. Air flow aperture devices 58*a* are hollow and are each aligned with one of apertures 56*a*.

Figure 12:
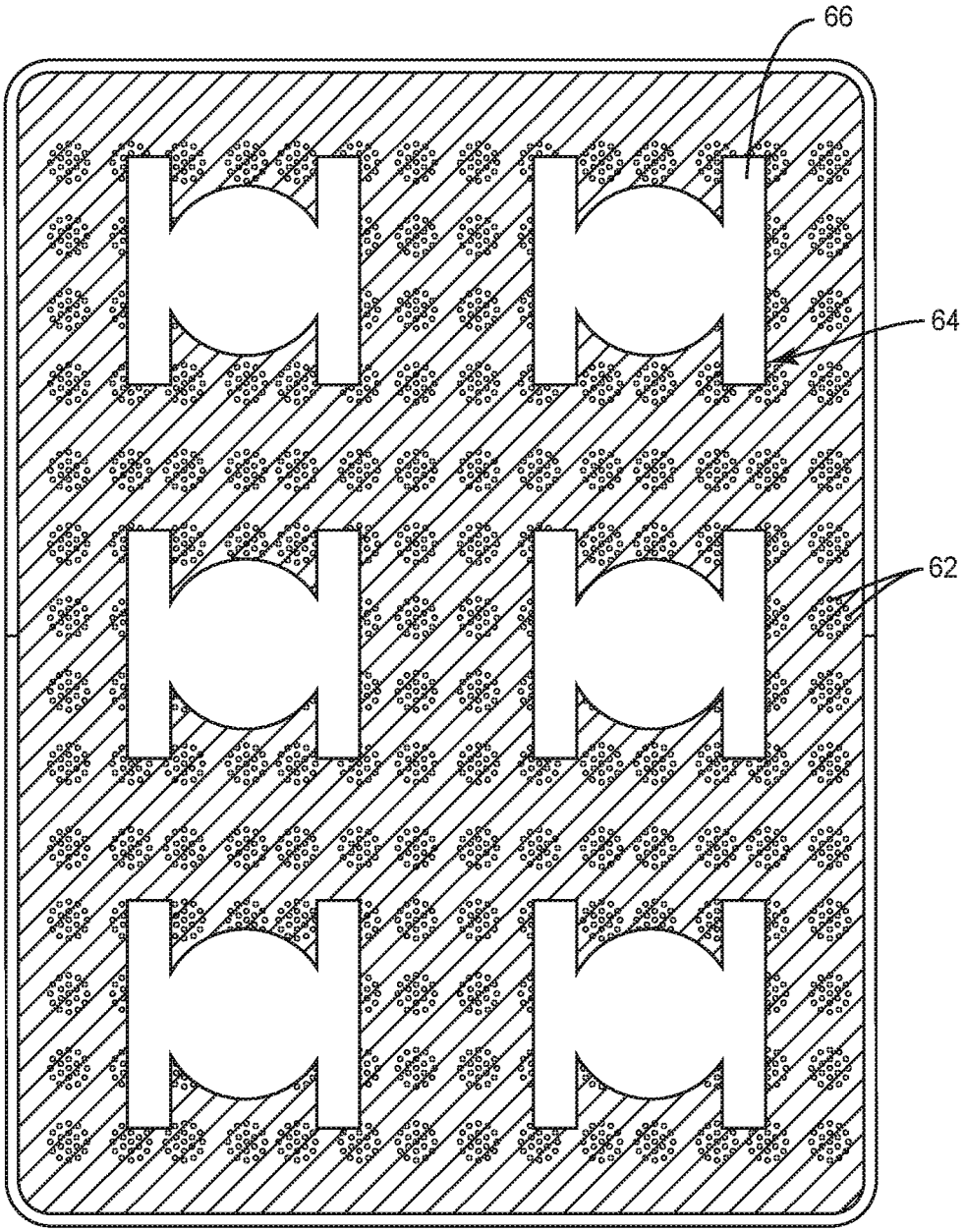
FIG. 12 is a cross-sectional view of components of the system shown in FIG. 1 taken along lines C-C in FIG. 11.

Mattress layer 26 is positioned atop capacitor layer 24 such that air flow aperture devices 58, 58*a* are aligned with first holes 60 that extend through a bottom surface of mattress layer 26. First holes 60 are in communication with one of apertures 56 and one of outlet ports 42 or are in communication with one of apertures 56*a*. Mattress layer 26 includes a plurality of sets of second holes 62, each set of second holes 62 being in communication with one of first holes 60. That is, each first hole 60 is in communication with a plurality of second holes 62 that each extend through sleep surface 28. First holes 60 each have a diameter that is greater than that of each of second holes 62 such that the holes in mattress layer 26 decrease in diameter and increase in quantity from the bottom surface of mattress layer 26 to sleep surface 28. First holes 60 each extend parallel to each of second holes 62. In one embodiment, at least one of second holes 62 is coaxial with a respective one of first holes 60 and at least one of second holes 62 is offset from a longitudinal axis defined by the respective one of first holes 60. In one embodiment, each set of second holes 62 has a circular configuration, as shown in FIG. 12 with one second hole 62 at the center of the set, a first ring of second holes 62 extending radially about the one second hole 62 and a second ring of second holes 62 extending radially about the first ring of second holes 62. In some embodiments, mattress layer 26 includes only first holes 60 wherein first holes 60 each extend continuously through and between the bottom surface of mattress layer 26 and sleep surface 28 of mattress layer 26. That is, mattress layer 26 does not include second holes 62. In some embodiments, mattress layer 26 includes only second holes 62 wherein second holes 62 each extend continuously through and between the bottom surface of mattress layer 26 and sleep surface 28 of mattress layer 26. That is, mattress layer 26 does not include first holes 60.

Figure 13:
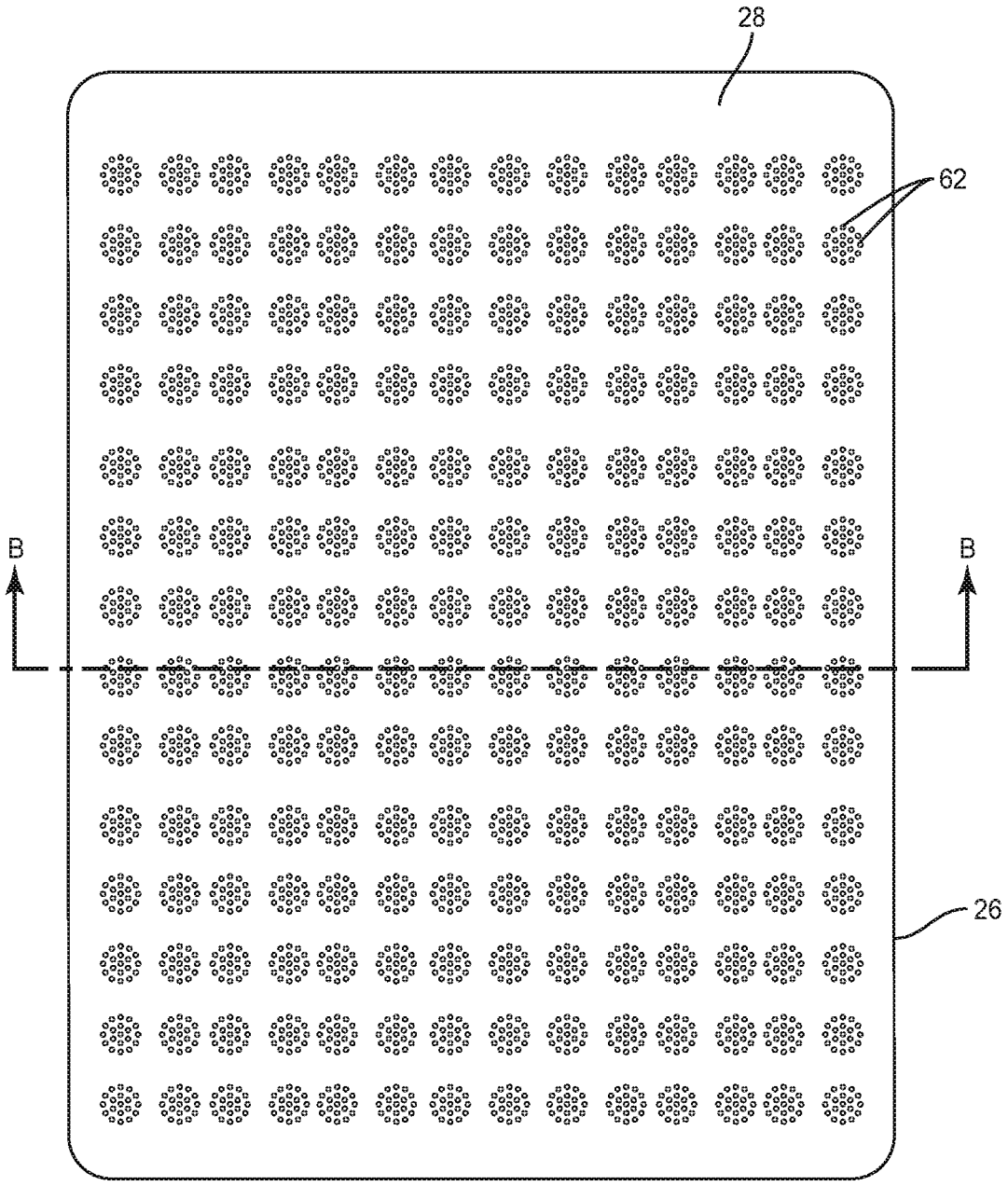
FIG. 13 is a top view of components of the system shown in FIG. 1.
Figure 14:
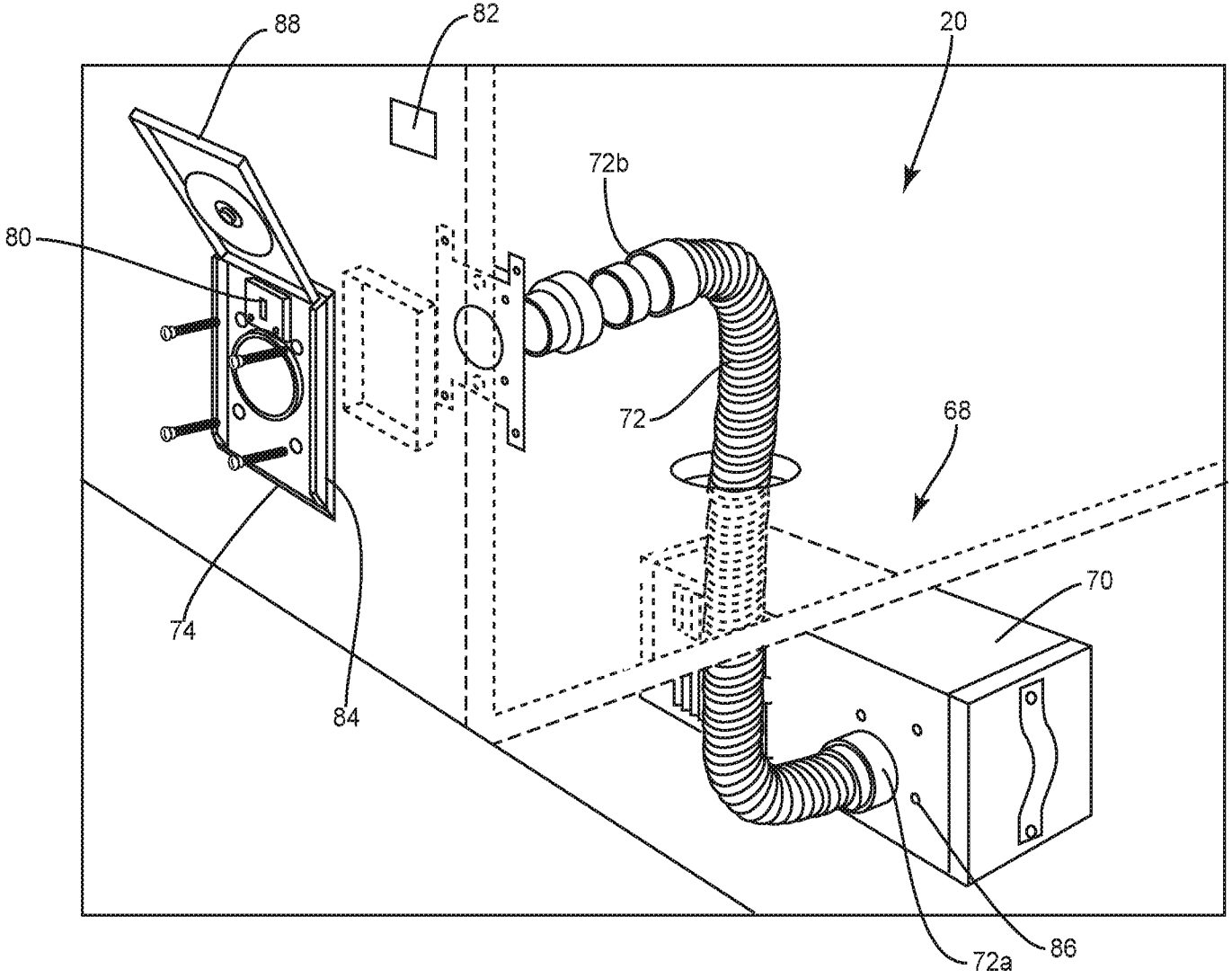
FIG. 14 is a perspective view of components of the system shown in FIG. 1.

In some embodiments, mattress layer 26 includes a plurality of cavities 64 extending perpendicular to second holes 62 such that cavities 64 each extend through a plurality of second holes 62, as shown in FIGS. 3, 13 and 14, for example. Each of cavities 64 is aligned with one of outlet ports 42. In one embodiment, cavities 64 each include opposite linear portions and an arcuate portion therebetween, as shown in FIG. 14. The linear portions at as a conduit/airflow channel portion and the round center or arcuate portion acts as a void space to draw from. In one embodiment, cavities 64 each have an insert 66 disposed therein, as shown in FIG. 14. In one embodiment, inserts 66 are made of foam, such as, for example, reticulated foam. In one embodiment, cavities 64 each extend perpendicular to each of second holes 62. In one embodiment, cavities 64 are positioned below sleep surface 28. In one embodiment, cavities 64 and inserts 66 are positioned to span across a plurality of sets of second holes 62 to provide an area will an ample size to draw air from sleep surface 38 into. Indeed, if cavities 64 were too small or too few, it is likely that there would not be an ample area to draw air from sleep surface 38 into such that the amount of air from sleep surface 38 that enters second holes 62 would be reduced. Cavities 64 and inserts 66 allow air that moves perpendicular to sleep surface 28 within second holes 62 to move parallel to sleep surface 28 within cavities 64 and inserts 66. This, for example, allows air that is moving vertically within one of second holes 62 in a direction that moves away from sleep surface 28 to enter one of cavities 64 and inserts 66 and move laterally within the cavity 64 and insert 66 such that the air may continue to move vertically in a different one of second holes 62 in the direction that moves away from sleep surface 28. That is, cavities 64 and inserts 66 create a partially open cavity of space, which intersects a plurality of second holes 62 to allow the draw of air from cavities 64. The orientation of cavities 64 and inserts 66 in relation to the sleeper are configured to be positioned adjacent the sleeper's head, torso, and feet, as these areas of the body are most often affected by increases and decreases in temperature.

In some embodiments, mattress layer 26 is positioned directly on top of box layer 22 such that passageways 32 of ducts are in fluid communication with holes 60 and/or holes 62. That is, bedding system 20 may not include a capacitor layer 24 such that the bottom surface of mattress layer 26 directly engages outlet ports 42. In some embodiments, outlet ports 42 may extend into and/or through the bottom surface of mattress layer 26. This configuration allows air on sleep surface 28 to move through holes 60, 62 and then move directly into passageways 32, as discussed herein.

Figure 15:
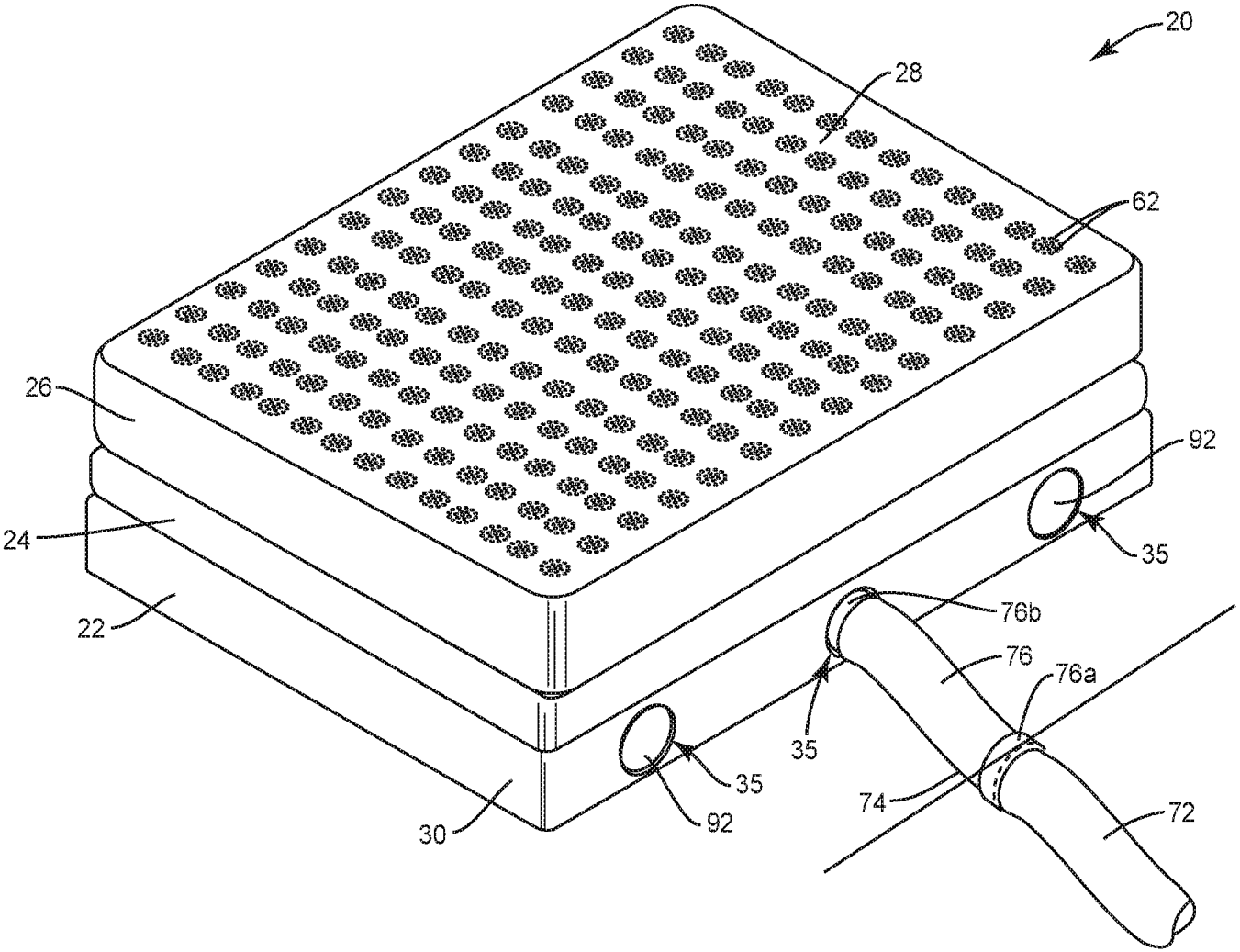
FIG. 15 is a perspective view of components of the system shown in FIG. 1.

Bedding system 20 includes a central vacuum system 68, as shown in FIGS. 14 and 15. Central vacuum system 68 comprises a power unit 70, a pipe 72 having a first end 72*a* that is connected to power unit 70 and a second end 72*b* that is connected to an outlet 74. Outlet 74 is configured for disposal of a first end 76*a* of a hose 76. A second end 76*b* of hose 76 is configured for disposal in one of inlets 35, as shown in FIG. 15. In some embodiments, second end 76*b* of hose 76 is removably disposed in one of inlets 35. In some embodiments, an outer surface of second end 76*b* includes outer threads that mate with inner threads of one of inlets to couple second end 76*b* to one of inlets 35. In some embodiments, an outer surface of second end 76*b* engages an inner surface of one of inlets in a snap fit or friction fit configuration to couple second end 76*b* to one of inlets 35. It is envisioned that inlets 35 may each have a size and shape that cooperate with one another to allow second end 72*b* of hose 76 to be positioned in one of inlets 35. In some embodiments, second end 76*b* of hose 76 and/or inlets 35 can have various shape configurations, such as, for example, oval, oblong, polygonal, irregular, uniform, non-uniform, variable and/or tapered. In some embodiments, second end 76*b* of hose 76 is permanently and irremovably disposed in one of inlets 35. In some embodiments, at least one of pipe 72 and hose 76 is a tube, such, as for example a flexible tube.

In some embodiments, bedding system 20 includes one or more caps or covers 92 that are configured to cover any unused inlets 35. That is, a cap or cover 92 may be coupled to one or more of inlets 35 that do not include second end 76*b* of hose 76 disposed therein to prevent air from flowing in or out of passageways 32 of ducts 34 through the unused inlets 35, as shown in FIG. 15. In some embodiments, covers 92 completely prevent air from flowing in or out of passageways 32 of ducts 34 through the unused inlets 35. In some embodiments, covers 92 can each be variously connected with one of inlets 35, such as, for example, monolithic, integral connection, frictional engagement, threaded engagement, mutual grooves, screws, adhesive, nails, barbs and/or raised element. In some embodiments, bedding system 20 includes only one inlet 35. In some embodiments wherein bedding system 20 includes only one inlet 35, the plurality of ducts 34 are each in communication with the one inlet 35. This may eliminate the need to use covers 92 to cover unused inlets 35.

Power unit 70 includes a motor that is configured to create negative pressure, such as, for example, a vacuum when the motor is in an on position to provide suction within hose 76. When the motor is turned from the on position to an off position, suction is stopped. That is, power unit 70 is configured to create a vacuum that draws air from sleep surface 28 and moves the air through holes 60, 62 and into cavity 48 such that the air moves through one of ducts 34 and into hose 76 through one of inlets 35. This allows warm air to be moved away from sleep surface 28, thus providing a cooling effect to sleep surface 28. For example, the temperature of sleep surface 28 may increase due to a person's body temperature, creating an uncomfortable sleep environment. The temperature of sleep surface 28 may be reduced by turning the motor of power unit 70 from the off position to the on position such that power unit 70 creates a vacuum that draws warm air from sleep surface 28 and moves the air through holes 60, 62 and into cavity 48 such that the air moves through one of ducts 34 and into hose 76 through one of inlets 35.

In some embodiments, power unit 70 comprises a sensor, such as, for example, a power sensor 86, as shown in FIG. 14. Power sensor 86 is configured to move the motor between the on and off positions. It is envisioned that bedding system 20 may include a remote control that communicates with power sensor 86 to turn the motor on and off. For example, should a sleeper desire to decrease the temperature of sleep surface 28, the sleeper can use the remote control to turn the motor of power unit 70 from the off position to the on position such that power unit 70 creates a vacuum that draws warm air from sleep surface 28 and moves the air through holes 60, 62 and into cavity 48 such that the air moves through one of ducts 34 and into hose 76 through one of inlets 35. When sleep surface 28 reaches a comfortable temperature, the sleeper can operate the remote control to turn the motor of power unit 70 from the on position to the off position to terminate any suction created by power unit 70 to prevent air from being drawn from sleep surface 28 and moved through holes 60, 62 and into cavity 48 such that the air moves through one of ducts 34 and into hose 76 through one of inlets 35. In some embodiments, the remote control is a smart phone. In some embodiments, the remote control is a tablet or computer. In some embodiments, the remote control is voice activated to allow a sleeper to turn the motor on and off using a voice command, thus eliminating the need to hold or otherwise touch the remote control.

In some embodiments, bedding system 20 comprises a temperature sensor 88, as shown in FIG. 14. Temperature sensor 88 is configured to send a signal to power sensor 86 to move the motor from the off position to the on position when temperature sensor 88 detects a temperature below a threshold temperature. This allows power unit 70 to create a vacuum that draws warm air from sleep surface 28 and moves the air through hole 60, 62 and into cavity 48 such that the air moves through one of ducts 34 and into hose 76 through one of inlets 35. In some embodiments, temperature sensor 88 is configured to send a signal to power sensor 86 to move the motor from the on position to the off position when temperature sensor 88 detects a temperature above a threshold temperature. This terminates any suction created by power unit 70 to prevent air from being drawn from sleep surface 28 and moved through holes 60, 62 and into cavity 48 such that the air moves through one of ducts 34 and into hose 76 through one of inlets 35. In some embodiments, temperature sensor 88 is part of a thermostat. That is, bedding system 20 may be integrated with an existing thermostat in a home or other building such that the thermostat sends a signal to power sensor 86 to move the motor from the off position to the on position when the thermostat detects a temperature below a threshold temperature. Likewise, the thermostat can send a signal to power sensor 86 to move the motor from the on position to the off position when the thermostat detects a temperature above a threshold temperature. This allows the motor of power unit 70 to be turned on and off automatically, based on the temperature in a room, as detected by the thermostat. It is envisioned that the thermostat can also function to regulate the temperature of one or more rooms within a building or other structure by turning an HVAC system on and off, for example.

Figure 2:
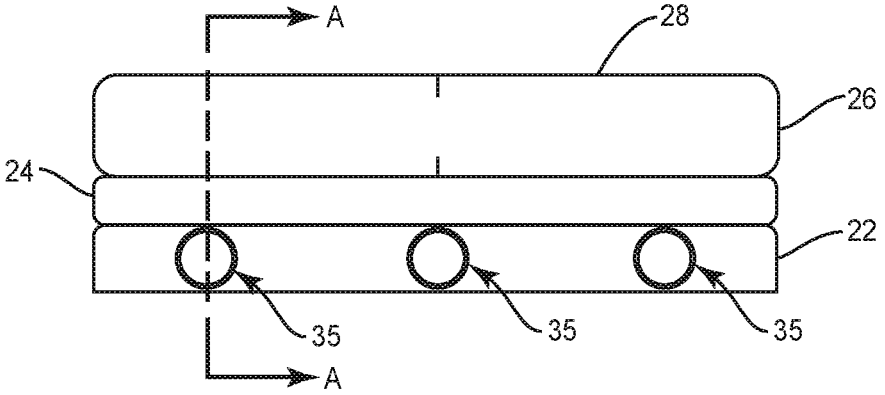
FIG. 2 is a side view of components of the system as shown in FIG. 1.

In some embodiments, bedding system 20 comprises a pressure sensor 90, as shown in FIG. 2. Pressure sensor 90 is in communication with temperature sensor 88. Pressure sensor 90 may be positioned within mattress layer 26 such that pressure sensor 90 can detect when a person is lying on sleep surface 28. In some embodiments, pressure sensor 90 is positioned below one of cavities 64. In some embodiments, pressure sensor 90 is positioned above one of cavities 64. In some embodiments, pressure sensor 90 is positioned within one of holes 60 and/or holes 62. In some embodiments, bedding system 20 comprises two or more pressure sensors 90. It is envisioned that one of pressure sensors 90 may be positioned on one side of mattress layer 26 and the other one of pressure sensors may be positioned on an opposite side of mattress layer 26, as shown in FIG. 2. This allows one of pressure sensors 90 to be positioned under a person that sleeps on the left side of mattress layer 26 and the other one of pressure sensors 90 to be positioned under a person that sleeps on the right side of the bed. Pressure sensors 90 are configured to send a signal to temperature sensor 88 when pressure sensor 90 detects a person lying on sleep surface 28. For example, temperature sensor 88 may remain off until one of pressure sensors 90 sends a signal to temperature sensor 88 to turn temperature sensor 88 on. Once temperature sensor 88 is turned on after receiving the signal from one of pressure sensors 90, temperature sensor 88 will send a signal to power sensor 86 to move the motor from the off position to the on position when temperature sensor 88 detects a temperature below a threshold temperature and/or to send a signal to power sensor 86 to move the motor from the on position to the off position when temperature sensor 88 detects a temperature above a threshold temperature. Pressure sensor(s) 90 thus prevent(s) the motor of power unit 70 from being turned on when no one is lying on sleep surface 28.

In some embodiments, hose 76 comprises a switch that is in communication with the motor of power unit 70. The switch is configured to move the motor between the on and off positions. For example, should a sleeper desire to decrease the temperature of sleep surface 28, the sleeper can operate the switch on hose 76 to turn the motor of power unit 70 from the off position to the on position such that power unit 70 creates a vacuum that draws warm air from sleep surface 28 and moves the air through holes 60, 62 and into cavity 48 such that the air moves through one of ducts 34 and into hose 76 through one of inlets 35. When sleep surface 28 reaches a comfortable temperature, the sleeper can operate the switch on hose 76 to turn the motor of power unit 70 from the on position to the off position to terminate any suction created by power unit 70 to prevent air from being drawn from sleep surface 28 and moved through holes 60, 62 and into cavity 48 such that the air moves through one of ducts 34 and into hose 76 through one of inlets 35.

Figure 16:
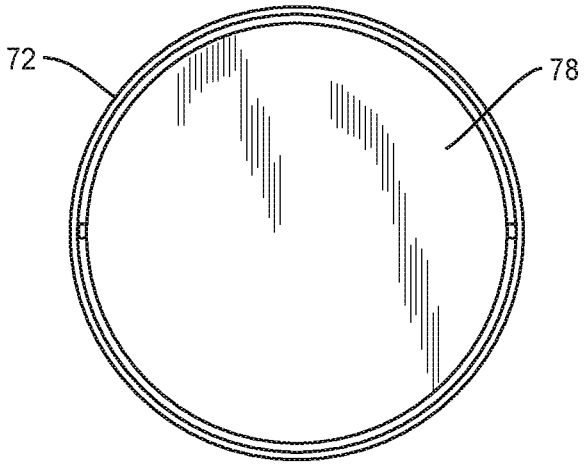
FIG. 16 is a cross sectional view of components of the system shown in FIG. 1.
Figure 17:
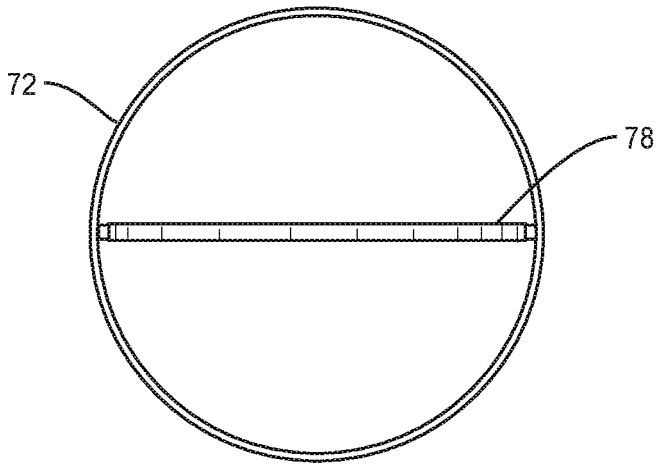
FIG. 17 is a cross sectional view of components of the system shown in FIG. 1.

In one embodiment, pipe 72 includes a flap 78 positioned therein, as shown in FIGS. 16 and 17. Flap 78 is movable between a first configuration in which flap 78 blocks the flow of air through pipe 72, as shown in FIG. 16, and a second configuration in which flap 78 allows air to flow through pipe 72, as shown in FIG. 17. When flap 78 is in the first configuration, there is no suction within hose 76 to prevent air from being drawn from sleep surface 28 and moved through holes 60, 62 and into cavity 48 such that the air moves through one of ducts 34 and into hose 76 through one of inlets 35. When flap 78 is in the second configuration, the vacuum created by power unit 70 draws warm air from sleep surface 28 and moves the air through holes 60, 62 and into cavity 48 such that the air moves through one of ducts 34 and into hose 76 through one of inlets 35. It is envisioned that flap 78 can move between the first and second configurations by a wired connection or wirelessly. For example, a sleeper can operate a switch, remote control, etc. to move flap 78 from the first configuration to the second configuration to draw warm air away from sleep surface 28, for example. In some embodiments, a gasket or O-ring may be provided about all or a portion of flap 78 such that the gasket or O-ring forms an air tight seal with an inner surface of pipe 72 when flap is in the first configuration.

In some embodiments, outlet 74 includes a switch 80, as shown in FIG. 14. Switch 80 is configured to move flap 78 between the first and second configurations. In one embodiment, switch 80 is in an extended orientation when flap 78 is in the second configuration and is in a depressed orientation when flap 78 is in the first configuration. In some embodiments, switch 80 is biased to the extended orientation such that the sleeper must move switch 80 from the depressed orientation to the extended orientation in order to move flap 78 from the first configuration to the second configuration. In some embodiments, switch 80 may be moved from the depressed orientation to the extended orientation by disengaging a cover 82 of outlet 74 from a body 84 of outlet 74. That is, cover 82 may be rotated relative to body 84 such that cover 82 no longer presses in on switch 80. In some embodiments, switch 80 may be moved from the extended orientation to the depressed orientation by rotating cover 82 relative to body 84 such that cover engages switch 80 and presses switch 80 inwardly to the depressed orientation.

In some embodiments, switch 80 is configured to move the motor of power unit 70 from the off position to the on position such that power unit 70 creates a vacuum that draws warm air from sleep surface 28 and moves the air through holes 60, 62 and into cavity 48 such that the air moves through one of ducts 34 and into hose 76 through one of inlets 35. For example, switch 80 may be moved from the depressed orientation to the extended orientation by disengaging cover 82 of outlet 74 from body 84 of outlet 74 to move the motor of power unit 70 from the off position to the on position. That is, cover 82 may be rotated relative to body 84 such that cover 82 no longer presses in on switch 80. In some embodiments, switch 80 may be moved from the extended orientation to the depressed orientation by rotating cover 82 relative to body 84 such that cover engages switch 80 and presses switch 80 inwardly to the depressed orientation to move the motor of power unit 70 from the on position to the off position.

In some embodiments, bedding system 20 is configured for use with a preexisting HVAC system in a building or other structure. In particular, a first end of a hose, such as, for example, hose 76 can be connected to a duct of the HVAC system and a second end of the hose can be connected to one of inlets 35. This will allow air to move from the duct of the HVAC system and into passageway 32 of one of ducts 34 through one of inlets 35. The air will move out of the passageway 32 and into cavity 48 of capacitor layer 24. The air will move through holes 60, 62 and will exit holes 62 through openings that extend through sleep surface 28. This allows cool or warm air from the HVAC system to be circulated on sleep surface 28 to heat or cool sleep surface 28. This may help to maintain an air temperature adjacent to sleep surface 28 that is the same or substantially the same as an air temperature of a room or other area in which components of bedding system 20, such as, for example, mattress layer 26 are positioned.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A method of regulating a condition, the method comprising:

providing an article of bedding comprising an uppermost surface and an opposite lowermost surface, the article of bedding comprising a mattress and a base, the mattress including a sleep surface defining the uppermost surface, the base defining the lowermost surface and comprising an inlet that is spaced apart from the mattress;

providing a connection from a vacuum to the inlet, at least a portion of the connection being located outside of the article of bedding;

sending a first signal from a first sensor to a second sensor to move the second sensor from an off position to an on position, the first sensor and the second sensor each operatively associated with the article of bedding;

determining a value of the condition about the inlet using the second sensor when the second sensor is in the on position; and sending a second signal from the second sensor to the vacuum such that the vacuum draws air from the sleep surface through the inlet to change a value of the condition of the sleep surface.

2. A method as recited in claim 1, wherein the condition is temperature and the value is degrees.

3. A method as recited in claim 1, wherein the condition is temperature and the value is degrees, the vacuum drawing air from the sleep surface to change the value from a first amount of degrees to a second amount of degrees that is less than the first amount of degrees.

4. A method as recited in claim 1, wherein the first sensor is a pressure sensor and the second sensor is a temperature sensor.

5. A method as recited in claim 1, further comprising sending a third signal from the second sensor to the vacuum such that the vacuum stops drawing air from the sleep surface.

6. A method as recited in claim 1, wherein the article of bedding includes a duct extending from the inlet into a cavity of the mattress.

7. A method as recited in claim 1, wherein the second sensor is configured to turn the vacuum on when the value exceeds a selected threshold.

8. A method as recited in claim 1, wherein the vacuum is part of a central vacuum system.

9. A method as recited in claim 1, wherein the inlet is in communication with a cavity of the article of bedding.

10. A method as recited in claim 1, wherein the vacuum comprises a motor and the second signal turns the motor on to cause the vacuum to create negative pressure that draws air from the sleep surface.

11. A method as recited in claim 1, wherein the sleep surface includes a plurality of pores that are in communication with the vacuum.

12. A method as recited in claim 1, wherein the first sensor is a remote control for the article of bedding and the second sensor is a temperature sensor.

13. A method of regulating a temperature, the method comprising:

providing an article of bedding comprising an uppermost surface and an opposite lowermost surface, the article of bedding comprising a mattress comprising a cushion and a base, the cushion including a sleep surface defining the uppermost surface, the base defining the lowermost surface and comprising an inlet that is spaced apart from the cushion;

providing a connection from a vacuum to the inlet, at least a portion of the connection being located outside of the article of bedding;

sending a first signal from a pressure sensor to a temperature sensor to move the temperature sensor from an off position to an on position, the sensors each operatively associated with the article of bedding;

determining the temperature about the inlet using the temperature sensor when the temperature sensor is in the on position; and sending a second signal from the temperature sensor to the vacuum such that the vacuum draws air from the sleep surface through the inlet to decrease a temperature of the sleep surface.

14. A method as recited in claim 13, wherein the temperature sensor is configured to turn the vacuum on when the temperature exceeds a selected temperature.

15. A method as recited in claim 13, further comprising sending a third signal from the temperature sensor to the vacuum such that the vacuum stops drawing air.

16. A method as recited in claim 13, wherein the vacuum comprises a motor and a signal from a remote control turns the motor on to cause the vacuum to create negative pressure that draws air.

17. A method as recited in claim 13, wherein the pressure sensor is a remote control for the article of bedding.

18. A method of regulating a temperature, the method comprising:

providing an article of bedding comprising an uppermost surface and an opposite lowermost surface, the article of bedding comprising a cushion and a base, the cushion defining the uppermost surface, the base defining the lowermost surface and comprising an inlet that is spaced apart from the cushion, the article of bedding comprising a duct that extends from the inlet into a cavity of the cushion;

providing a connection from a vacuum to the cushion, at least a portion of the connection being located outside of the article of bedding;

sending a first signal from a pressure sensor to a temperature sensor to move the temperature sensor from an off position to an on position, the sensors each operatively associated with the article of bedding;

sending a second signal from the temperature sensor to the vacuum such that the vacuum draws air to decrease the temperature; and sending a third signal from a remote control to the vacuum such that the vacuum creates negative pressure that draws air from the cushion cavity through the inlet to decrease a temperature of the cushion cavity.

19. A method as recited in claim 18, further comprising sending a fourth signal from the remote control to the vacuum to terminate any negative pressure created by the vacuum.

* * * * *